US008083619B1

(12) United States Patent
Turos

(10) Patent No.: US 8,083,619 B1
(45) Date of Patent: Dec. 27, 2011

(54) PRACTICE BAT AND METHOD FOR USE

(75) Inventor: Kenneth Turos, Albuquerque, NM (US)

(73) Assignee: Sun Systems, Inc., Las Cruces, NM (US)

( * ) Notice: Subject to any disclaimer, the term of this patent is extended or adjusted under 35 U.S.C. 154(b) by 1226 days.

(21) Appl. No.: 10/719,458

(22) Filed: Nov. 21, 2003

Related U.S. Application Data

(63) Continuation-in-part of application No. 09/970,738, filed on Oct. 4, 2001, now abandoned.

(51) Int. Cl.
*A63B 69/00* (2006.01)

(52) U.S. Cl. ..... 473/457; 473/422

(58) Field of Classification Search ..... 473/457, 473/433, 519, 520, 558–568, 422
See application file for complete search history.

(56) References Cited

U.S. PATENT DOCUMENTS

| | | | | | |
|---|---|---|---|---|---|
| 83,228 | A * | 10/1868 | Warne | 463/47.7 |
| 2,757,002 | A * | 7/1956 | Ryden | 43/4 |
| 3,618,945 | A * | 11/1971 | Kuchar et al. | 473/457 |
| 3,729,196 | A * | 4/1973 | Heald, Jr. | 473/520 |
| 4,951,948 | A * | 8/1990 | Peng | 473/520 |
| 5,219,164 | A * | 6/1993 | Peng | 473/520 |
| 5,294,117 | A * | 3/1994 | Huang | 473/523 |
| 5,624,114 | A * | 4/1997 | Kelsey | 473/520 |
| 6,050,908 | A * | 4/2000 | Muhlhausen | 473/457 |
| 6,099,422 | A * | 8/2000 | Rappaport et al. | 473/567 |
| 6,210,302 | B1 * | 4/2001 | Globus | 482/37 |
| 6,406,387 | B1 * | 6/2002 | Ryan | 473/457 |
| 6,485,382 | B1 * | 11/2002 | Chen | 473/566 |
| 6,511,392 | B1 * | 1/2003 | Chohan | 473/564 |
| 6,569,042 | B2 * | 5/2003 | LaChance et al. | 473/457 |
| 6,652,398 | B2 * | 11/2003 | Falone et al. | 473/568 |
| 6,949,036 | B2 * | 9/2005 | Ciesar et al. | 473/457 |
| 2003/0032495 | A1 * | 2/2003 | Huang | 473/300 |
| 2004/0224801 | A1 * | 11/2004 | Forsythe et al. | 473/564 |
| 2004/0224803 | A1 * | 11/2004 | Forsythe et al. | 473/564 |
| 2005/0064965 | A1 * | 3/2005 | Flood | 473/568 |

* cited by examiner

*Primary Examiner* — Mitra Aryanpour
(74) *Attorney, Agent, or Firm* — Ray R. Regan

(57) ABSTRACT

An apparatus and method for improving batting a baseball is provided. The apparatus includes at least one hollow tube and at least one substantially solid tube, both formed with openings at opposing ends. A handle is removably attachable to one end of the tubes. A plug is insertable into one opening in the tubes for eliminating bat deformation from ball-to-bat impacts. A cap is included in the other end of the tubes for controlling acoustics, thus providing a sound on ball-to-bat impact comparable to that of conventionally dimensioned wood bats. A grip knob is provided at one end of the handle for restraining hands during swinging. A compressible sleeve is slidably engageable with the handle for providing a hand grip. The apparatus and method for improving batting is used in combination with a training regimen to improve batting skills.

7 Claims, 4 Drawing Sheets

PRACTICE BAT AND METHOD FOR USE

CROSS-REFERENCE TO RELATED APPLICATION

This application is a continuation-in-part of U.S. application Ser. No. 09/970,738 filed in the U.S. Patent Office on Oct. 4, 2001 now abandoned.

FIELD OF TECHNOLOGY

A practice bat and method pertains generally to athletics. More particularly, the practice bat, and a regimen for using the bat, provides a system for improving athletic proficiency. The practice bat is particularly useful for improving baseball and softball batting proficiency.

BACKGROUND

The desire to improve athletic proficiency is a universal gender-neutral goal of millions of people. The practice bat and method for its use achieves enhanced athletic proficiency in batting a baseball or softball by at least enhancing hand-eye coordination to more effectively and efficiently swing a bat to contact a pitched ball ("batting" or "hitting").

SUMMARY

The practice bat, in combination with a practice regimen, increases batting efficiency and proficiency. The practice bat includes at least one tube, or head. At least one of the tubes or heads is substantially hollow with opposing openings. At least one of the tubes is substantially solid with opposing openings. A sleeved end cap is mounted into one opposing opening for controlling acoustics, namely to approximate the sound of a conventional ball impacting a conventional bat. A substantially solid shock-absorbing plug is inserted into the other opposing opening. The substantially solid shock absorbing plug eliminates bat deformation and reverberations from ball-to-bat impact. In one embodiment, the plug is made of metal. The term "eliminates bat deformation" as used in this document means at least avoidance of thread stripping in the threaded portions of the practice bat due to successive impacts between the practice bat and balls pitched or cast for hitting. The term "eliminates bat deformation" also means that the plug eliminates any bending of the components of the practice bat due to successive impacts between the practice bat and balls. The plug also eliminates alteration of any other form or shape of the practice bat. In addition to the tubes or heads, and the plug, the practice bat also includes handle threadably engageable with the tubes or heads. The handle includes no other device or apparatus for eliminating bat deformation or controlling acoustics other than the materials used to make the practice bat. In addition, means for gripping the handle, and the bat when assembled into a practice bat, are included.

The practice bat is designed to facilitate a training regimen to improve batting. At least one aspect of the training regimen includes application and use of the overload principle. The overload principle has been found to be useful for improving batting by using a heavier weight than normally is used in game conditions when using a conventional aluminum or wooden bat. By using the practice bat instead of conventionally dimensioned aluminum or wooden bats for practice drills, the increased weight of the practice bat, combined with the ability to step-increase the weight of the apparatus either upward or downward by use of variously weighted heads that are interchangeable on a handle, help develop greater bat speed, better bat control, better body efficiency, better muscle memory, and enhanced hand-eye coordination, all of which in turn help develop a positive hitting attitude.

The practice bat, in conjunction with the training regimen, leads to enhanced batting skills by decreasing hitting surface or area of the head. In one embodiment of the practice bat, the interchangeable and removable heads are one inch in exterior diameter. Accordingly, the head of the practice bat presents approximately 160 percent less hitting or ball contact area than a typical baseball bat used in game conditions. As will be evident to those skilled in the art, use of a smaller diameter head in hitting drills will develop greater hand-eye coordination, and contributes to making the practice bat an ideal tool for bunting drills.

Overload training in combination with the practice bat allows a user to place greater emphasis on the path of the hands through the hitting zone. As a user learns to control the additional weight of the practice bat, greater emphasis automatically and reflexively is placed on proper linear movement of hands through the hitting zone. At the same time, better overall body control results, with a more fluid motion and follow through.

In addition, use of the practice bat generates greater awareness of the importance of overall physical conditioning body coordination by encouraging increased body and bat leverage as the user resists additional centrifugal forces sensed during use of the practice bat. All muscles generally exercised during batting are used and challenged when using the practice bat.

Successful hitting requires mental, as well as physical, conditioning. Following use of the practice bat as a practice tool, in combination with a proper training regimen, as a user progresses from the smaller diameter head to the larger diameter of a conventional baseball bat, chances increase to make successful contact with a pitched baseball. In addition, progressing from the heavier weights provided by the apparatus for improving batting, to the lighter bat heads of conventional game bats, causes greater bat speed. Both results lead to greater success as a hitter. Practice with the practice bat will cause hitters to trust reactions to a pitch, and to have confidence to instinctively hit the ball.

The advantages and other objects of the practice bat, and features of such an apparatus for improving batting, and method for using the apparatus, will become apparent to those skilled in the art when read in conjunction with the accompanying following description, drawing figures, and appended claims.

Thus, it is clear from the foregoing that the new and useful claimed subject matter as a whole, including the structure of the apparatus, and the cooperation of the elements of the apparatus, as well as the method for the apparatus, combine to result in a number of unexpected advantages and utilities of the practice bat.

The foregoing has outlined broadly the more important features of the invention to better understand the detailed description, which follows, and to better understand the contribution of the practice bat to the art. Before explaining at least one embodiment of the invention in detail, it is to be understood that the invention is not limited in application to the details of construction, and to the arrangements of the components, provided in the following description or drawing figures. The invention is capable of other embodiments, and of being practiced and carried out in various ways. Also, the phraseology and terminology employed in this disclosure are for purpose of description, and should not be regarded as limiting.

As those skilled in the art will appreciate, the conception on which this disclosure is based readily may be used as a basis for designing other structures, methods, and systems for carrying out the purposes of the practice bat. The claims, therefore, include such equivalent constructions to the extent the equivalent constructions do not depart from the spirit and scope of the practice bat. Further, the abstract associated with this disclosure is neither intended to define the invention, which is measured by the claims, nor intended to be limiting as to the scope of the invention in any way.

The novel features of this invention, and the invention itself, both as to structure and operation, are best understood from the accompanying drawing, considered in connection with the accompanying description of the drawing, in which similar reference characters refer to similar parts, and in which:

DETAILED DESCRIPTION

Hitting a round baseball with a tapered cylindrical bat is a daunting task. A baseball, traditionally made with a cork and rubber core and tightly wrapped yarn, is covered with white leather panels sewn together. Rules and regulations prescribe that the circumference of a baseball must be only 9 to 9.25 inches, and weigh between five and 5.25 ounces. Rules and regulations also require that a bat may not exceed 42 inches in length, or have a thickness at the barrel, or hitting end, greater than 2.75 inches. Baseball bats traditionally are manufactured from ash wood, primarily white ash and green ash, a form of ash unique to the United States (collectively in this document, "game-approved bats"). Just how difficult hitting can be is exemplified by a well-known statistic: achieving a 0.333 batting average is considered excellent.

The practice bat disclosed in this document is designed to improve batting averages, while also precluding damage in the form of bat deformation, avoiding injury to a user of the practice bat, and providing an acoustical sound when the practice bat properly hits a baseball comparable to that of conventionally dimensioned bats made of conventional materials. The practice bat can be used to improve athletic proficiency, particularly to improve hitting a baseball during game conditions, with greater frequency, greater accuracy, greater predictability, and without inducing injury to a player's muscular system. Another limitation of prior approaches includes reliance for effectiveness on components that are not included on a game-approved bat, such as tips that must be inserted into the end of a bat used to make contact with a baseball.

Figure 1A:
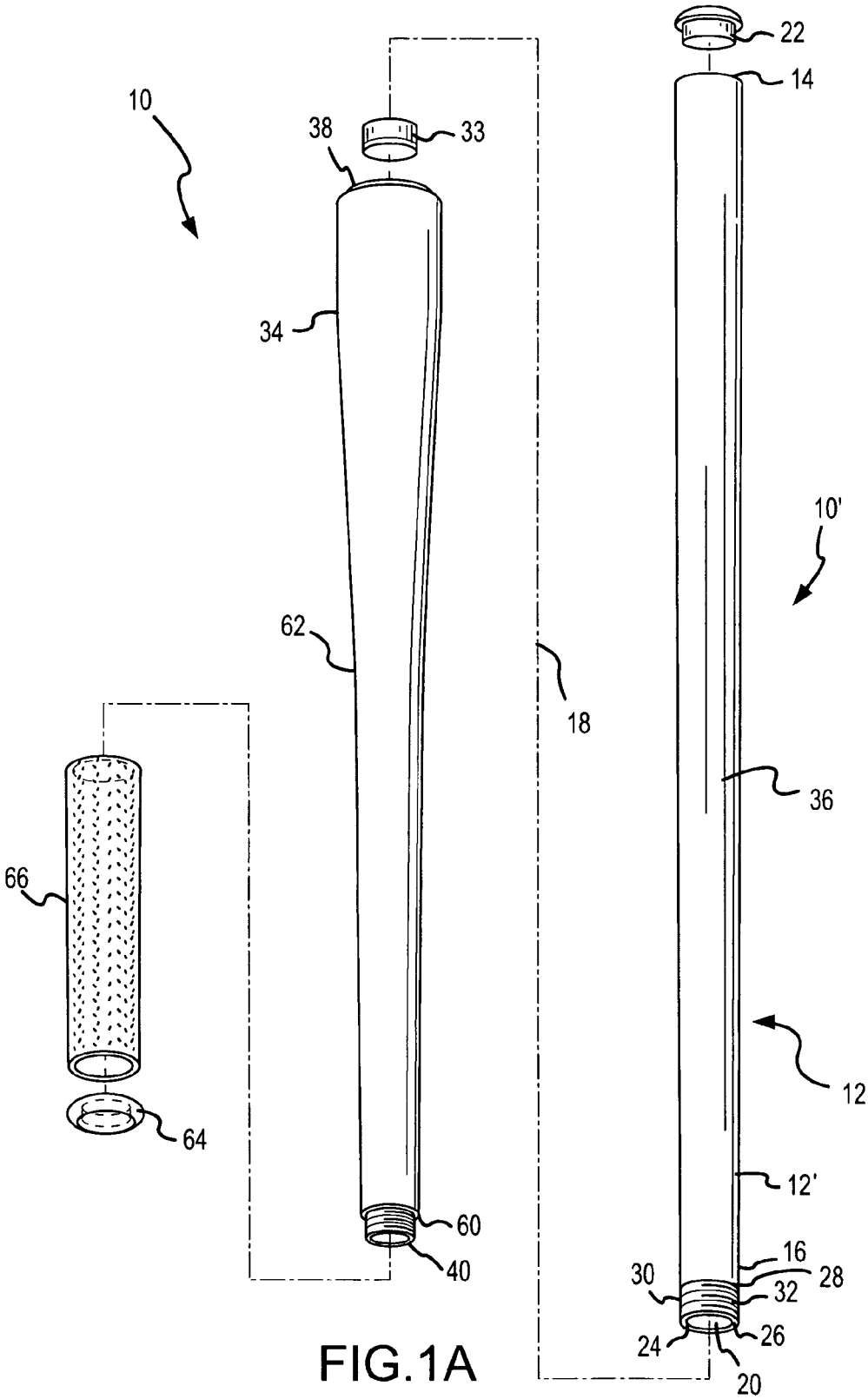
FIG. 1A is a perspective view of the unassembled practice bat.
Figure 1B:
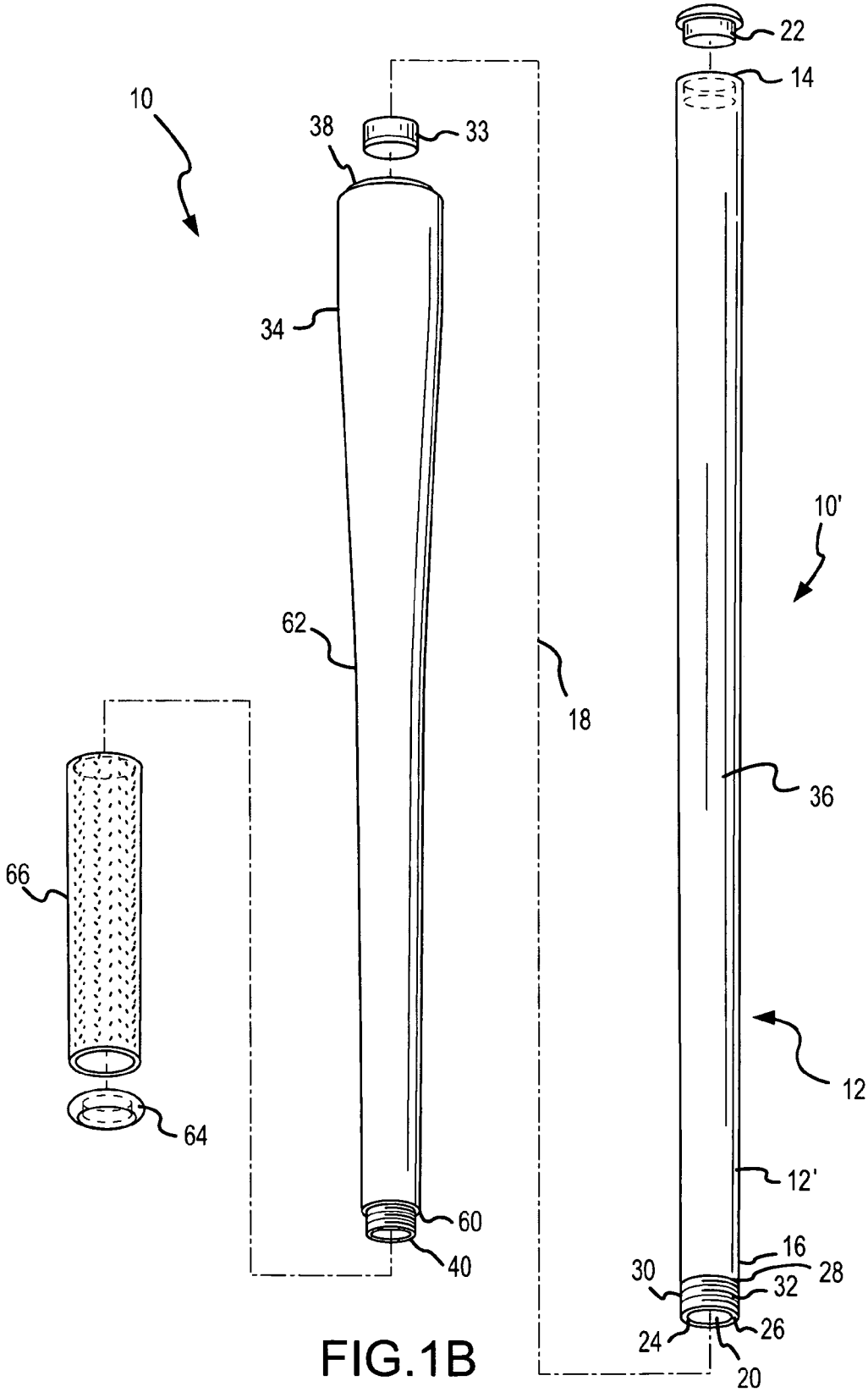
FIG. 1B is a perspective view of the system for improving batting efficiency.

FIG. 1 illustrates a perspective view of the practice bat with major elements and components. In one embodiment of practice bat 10, a practice bat 10 includes at least one tube 12. Tube 12 is formed with a distal end 14 and a proximal end 16. In addition, tube 12 is formed with a substantially uniform cross-section perpendicular to the longitudinal axis 18 through the axial length of tube 12 between proximal end 16 and distal end 14. In at least one embodiment of the practice bat 10, tube 12 of apparatus for improving athletic proficiency 10 is substantially solid. In an alternative embodiment, tube 12 is formed with a hollow chamber 20 and is therefore substantially hollow.

While tube 12 in one embodiment and in an alternative embodiment is described as either substantially solid or substantially hollow, in at least one commercial embodiment of the system of practice bat 10, three interchangeable tubes 12 are provided as part of the system. One tube 12 of the three tubes 12 is substantially solid, and two are substantially hollow. Using a plurality of interchangeable tubes 12 also easily assembles practice bat 10. In part because tube 12 may be either substantially solid or substantially hollow, tube 12 varies in weight. The varying weight is useful by providing a range of bat weights to use in a regimen for improving batting. Various configurations of tube 12 also vary in weight due to selection of different compositions of materials to make tube 12. In one embodiment of practice bat 10, a substantially solid version of tube 12 is manufactured from durable steel; substantially hollow versions of tube 12 may be made of molysteel, although the precise material and compositions of materials are not a limitation of practice bat 10. The different weights of tube 12 accommodate differing ages, sizes, skill levels, and objectives of a baseball player following a training regimen.

Also, in an embodiment of the practice bat, each tube 12 has a diameter of approximately one (1) inch and is color-coded by weight. Further, the weight of various tubes 12 is stamped on an end cap 22 insertable into distal end 14 of tube 12. The diameter of tube 12 therefore is significantly less than a game-approved bat. The smaller diameter of tube 12 is a further advantage of practice bat 10 in its use as a practice bat, requiring the user to more accurately swing practice bat 10, which transfers to a more accurate swing with a game-approved bat.

Figure 2:
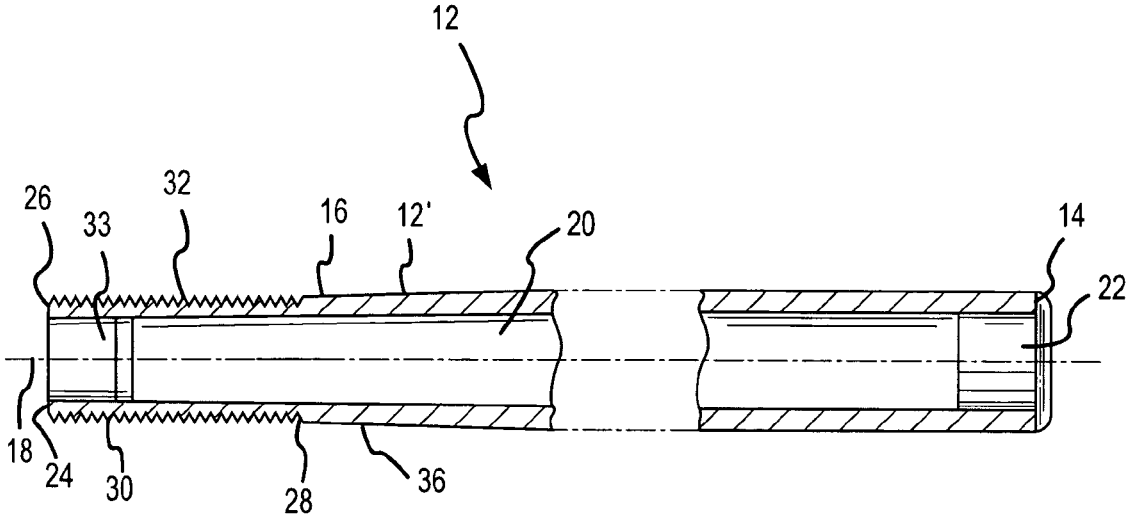
FIG. 2 is a side cross-sectional view of the tube, or head, of the practice bat.

As best shown in FIG. 2, in an embodiment of practice bat 10, tube 12 includes a monolithic collar 24 formed with a fore end 26, an aft end 28, and a surrounding surface 30. Monolithic collar 24 extends from proximal end 16 of tube 12. In one embodiment of practice bat 10, monolithic collar 24 extends approximately 1.5 inches from proximal end 16 of tube 12, but as will be evident to those skilled in the art, the distance that monolithic collar 24 extends from proximal end 16 of tube 12 is not a material limitation of practice bat 10. Also in one embodiment of practice bat 10, monolithic collar 24 is tapered between fore end 26 and the aft end 28. The tapering decreases toward aft end 28, with the result that fore end 26 has a smaller circumference than aft end 28. In addition, exterior threads 32 are formed on surrounding surface 30 for attachment of tube 12 to a handle 34 described below and shown in FIG. 3. Exterior threads 32 in one embodiment taper toward fore end 26, and in another embodiment do not taper. Exterior threads 32 improve the holding power between tube 12 and handle 34 despite repetitive and frequent use of practice bat 10 to impact a baseball impacting the exterior surface 36 of tube 12 at velocities often approaching 90 miles per hour ("mph"). The mounting of exterior threads 32 on monolithic collar 24 of tube 12, rather than on handle 34, provides mechanical advantages not found in other apparatus suggested for improving hitting proficiency. In combination with the complementary tapering exterior threads 32 of tube 12, and the internal recessed threads 50 on internal face 48 of handle 34 described below, the tapering causes tube 12 and handle 34 to continuously self-adjust when threaded together despite thread wear that may be caused by use during batting practice or by assembling and disassembling tube 12 from handle 34. If the respective threads wear, the tapering causes the respective threads of tube 12 and handle 34 to reseat without loss of any capabilities of apparatus for improving athletic proficiency 10.

A plug 33 also is provided with practice bat 10, as best shown in FIG. 2. Plug 33 is fixedly insertable into hollow chamber 20 of tube 12 adjacent fore end 26 of tube 12. In one embodiment of practice bat 10, plug 33 extends approximately 2 inches from fore end 26 into hollow chamber 20. Plug 33 provides an additional mechanical advantage not found in other apparatus for batting practice. As indicated, the velocity of a baseball making contact with apparatus for improving athletic proficiency 10 may approach 90 mph. On impact, significant forces, in a variety of vectors, including leverage forces between a point of impact of a ball on exterior surface 36 of tube 12, between the point of impact and grip knob 64, as discussed below, are applied to apparatus for improving athletic proficiency 10. Plug 33, however, absorbs such forces, and strengthens the gripping power of both internal recessed threads 50 on internal face 46 of handle 34 as well as exterior threads 32 of tube 12. Plug 33 also contributes to providing the comforting and desirable sound of a ball hitting a wood bat. Also, because an assembled embodiment of practice bat 10 is not shaped or configured dimensionally consistent with or to a game-approved baseball bat, a batter using practice bat 10 during a training regimen will encounter greater challenges during practice by reducing the available surface for hitting a baseball.

Figure 3:
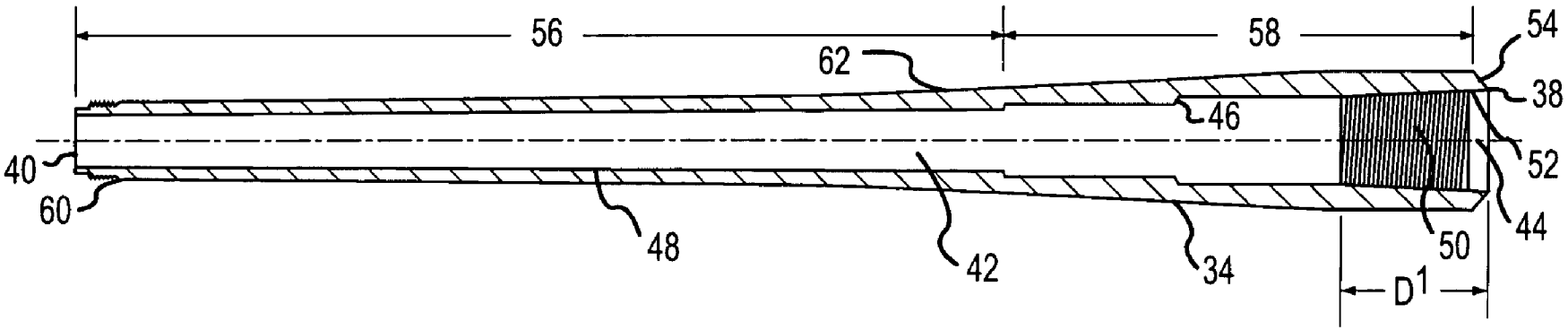
FIG. 3 is a side cross-sectional view of the handle of the practice bat.

In addition to tube 12, as previously indicated, practice bat 10 includes a handle 34 best shown in FIG. 3. Handle 34 is formed with a leading end 38, a following end 40, and a hollow passage 42 along the longitudinal axis 44 of handle 34. In one embodiment of practice bat, hollow passage 42 is formed to include one or more spaced tiers 46 in internal face 48 of hollow passage 42 adjacent leading end 38 of handle 34. The one or more spaced tiers 46 contribute to rigidity despite the hollowness of handle 34. As also shown in FIG. 3, handle 34 is formed with internal recessed threads 50 that are included in hollow passage 42 adjacent to leading end 38 of handle 34. In one embodiment of practice bat 10, internal recessed threads 50 are formed to taper along longitudinal axis 44 between a lower edge 52 of a recessed lip 54 formed in leading end 38 of handle 34. Internal recessed threads 50 extend into hollow passage 42 of handle 34 a distance exemplified by $D^1$ as shown in FIG. 3. In one embodiment of practice bat 10, internal recessed threads 50 extend into hollow passage 42 of handle 34 approximately 1.50 inches from lower edge 52 of recessed lip 54 formed in leading end 38 of handle 34, but the measurement is not a material limitation on practice bat 10. Internal recessed threads 50 are tapered along longitudinal axis 44 of handle 34 to substantially mirror the taper of exterior threads 32 formed in monolithic collar 24 of tube 12 for threadable engagement of tube 12 with handle 34.

As best shown in FIG. 3, handle 34 also is formed with a first extension 56 and a tapered extension 58 that monolithically extends from first extension 56. First extension extends from a rear end 60 toward leading end 38 of handle 34 approximately to a forward end 62, and tapered extension 58 extends from approximately forward end 62 toward leading end 38. In one embodiment of practice bat 10, first extension 56 is approximately 0.750 inch in diameter, and tapered extension 58 tapers to a maximum diameter of approximately 1.490 inches, but neither the location of forward end 62, nor the dimensions given are material limitations of practice bat 10.

As also shown by cross-reference between FIGS. 1 and 3, practice bat 10 includes a grip knob 64. Grip knob is fixedly connected to following end 40 of handle 34. Grip knob 64 precludes slippage of the assembled practice bat 10 from the hands of a user during use of practice bat 10. In addition, a compressible sleeve 66 is provided. Compressible sleeve 66 is slidably engageable with first extension 56 of handle 34, and aids in gripping the assembled practice bat 10 during a training regimen.

While practice bat 10 shown in drawing FIGS. 1 through 3 includes at least one embodiment of practice bat 10, it is not intended to be exclusive, and is not a limitation of practice bat 10. While the particular practice bat 10 as shown and disclosed in detail in this instrument is fully capable of obtaining the objects and providing the advantages stated, this disclosure is merely illustrative of the presently preferred embodiments of the invention, and no limitations are intended in connection with the details of construction, design or composition other than as provided and described in the appended claims.

Operation

In operation, practice bat 10 provides numerous advantages in connection with improving batting efficiency. Practice bat 10 provides a coordinated system and method, combined with the proper structure and cooperation of structure provided by practice bat 10 for practicing the proper methods for swinging a baseball bat and making contact with a baseball. By selecting the differently weighted tubes 12 that provide a consistent hitting surface, to use in assembled form with handle 34, practice bat 10 improves hitting a baseball during game conditions. Practice bat 10 is easily assembled and disassembled, and one or more interchangeable tubes 12 are available. By presenting a plurality of interchangeable heads 12' that vary in weight, bat swinging exercises in a training regimen may be devised to accommodate different ages, sizes, skill levels, and objectives of a baseball player.

Following a training regimen that includes swinging practice bat 10 through a variety of stances, improved proficiency in batting is achieved in part because head 12' is shaped differently than game-approved bats. Accordingly, a batter encounters greater challenges during practice by reducing the available hitting surface. handle 34 of practice bat 10, however, is ergonomically designed to mirror the feel of a game-approved bat.

The practice bat is designed to facilitate a training regimen to improve batting. At least one aspect of the training regimen includes application and use of the overload principle. The overload principle has been found by the inventor to rapidly improve batting because of the heavier weight of practice bat 10 as compared with a game-approved bat. The inventor has established that use of practice bat 10 instead of an aluminum or wooden bat for practice drills, with the capability of increasing or decreasing the weight of heads 12', helps develop greater bat speed, better bat control, better body efficiency, better muscle memory, enhanced hand-eye coordination, which in turn help develop a positive hitting attitude.

A regimen of practice swinging of practice bat 10 also leads to enhanced batting skills because of the limited hitting area presented by exterior surface 36 of head 12'. As previously indicated, in one embodiment of practice bat 10 the interchangeable and removable heads 12' are one inch in exterior diameter. Accordingly, head 12' presents approximately 160 percent less hitting or ball contact area on exterior surface 36 than a game-approved bat. As will be evident to those skilled in the art, use of a smaller diameter head 12' in hitting drills of a training regimen will develop greater hand-eye coordination, and contributes to making the practice bat an ideal tool for bunting drills.

In application of a training regimen, overload training in combination with the practice bat allows a user to place greater emphasis on the path of the hands through the hitting zone. As a user learns to control the additional weight of the practice bat, greater emphasis automatically and reflexively is placed on proper linear movement of hands through the hitting zone. At the same time, better overall body control results, with a more fluid motion and follow through.

An exemplary training specimen may include, but is not limited to, a hitting progression. In each hitting progression, different tubes 12 may be used, thus altering the weight being manipulated by the trainee. The batter may begin with a wide pre-stride stance, legs approximately 12-18 inches wider apart than a normal stance. No stride is taken, but the batter swings the practice bat 10 several times. In addition, or alternatively, the batter assumes a narrow pre-stride stance. Again, the batter takes no stride, but swings the practice bat 10 several times. The batter may then change heads 12' to practice a front hand overload drill in which the front hand, or hand closest to where a pitcher would be, is held close to the bottom of handle 34, a regular batting stance is assumed, the other hand is placed under the arm of the front hand, and the batter practices swinging practice bat 10 to achieve body control, follow through, and finish. In addition, or again alternatively, a batter may switch hands from the front hand overload drill to practice a backhand overload drill. Another remarkably useful drill to include in the training regimen is inversion: after gripping the practice bat in a normal way, the top hand is inverted so that the thumb of the top hand will be in contact with the top of the bottom hand. when striding and striking a ball in this stance, the top hand will be released from handle 34 on contact with a baseball and pushed through the hitting zone. Body and bat control are enhanced. Of course, regular batting also may be practiced. The practice bat is very useful in improving bunting.

In addition, use of the practice bat 10 generates greater awareness of the importance of overall physical conditioning body coordination by encouraging increased body and bat leverage as the user resists additional centrifugal forces sensed during use of the practice bat. All muscles generally exercised during a baseball game are used and challenged when using the practice bat. In addition, progressing from the heavier weights provided by the practice bat 10, to the lighter bat heads of conventional game bats, causes greater bat speed. Both results lead to greater success as a hitter. Practice with the practice bat will cause hitters to trust reactions to a pitch, and to have confidence to instinctively hit the ball. Accordingly, the practice bat promotes athletic proficiency rapidly and comfortably as a user moves between teamwork, cage work, on-deck drills, and batting practice.

What is claimed is:

1. A system for improving batting efficiency, comprising:

a plurality of heads of varying weight adapted to strike a baseball, wherein one or more of the plurality of heads is substantially hollow;

a handle threadably engageable with the plurality of heads;

means for controlling acoustics mountable on one or more of the plurality of heads;

means for eliminating deformation of the plurality of substantially hollow heads;

a sleeve slidably engageable with the handle; and a grip knob fixedly connected to an end of the handle.

2. A system for improving batting efficiency as recited in claim 1, wherein at least one of the plurality of heads is substantially solid.

3. A system for improving batting efficiency as recited in claim 1, wherein the handle includes no additional shock absorbing apparatus.

4. A system for improving batting efficiency as recited in claim 1, wherein the acoustics control means is an end cap.

5. A system for improving batting efficiency as recited in claim 4, wherein the deformation eliminating means is a substantially solid shock absorbing metal plug fixedly insertable into one end of the plurality of heads that are substantially hollow for eliminating bat deformation and reverberations from ball-to-bat impact.

6. A system for improving batting efficiency as recited in claim 1 wherein the deformation eliminating means is made from material selected from the group of materials consisting of molysteel, aluminum, resins, and plastics.

7. A system for improving batting efficiency as recited in claim 6, wherein the deformation eliminating means is pressed into one end of the plurality of heads that are substantially hollow.

* * * * *